US007280792B2

(12) United States Patent
Sawai et al.

(10) Patent No.: US 7,280,792 B2
(45) Date of Patent: Oct. 9, 2007

(54) METHOD FOR EVALUATING CHANGES IN RESISTANCE OF ELECTRIC RESISTANCE MEMBER AND IMAGE FORMING APPARATUS USING SAME

(75) Inventors: Yuuji Sawai, Kanagawa (JP); Yoshihiro Fujiwara, Kanagawa (JP); Shin Kayahara, Chiba (JP); Hiromi Ogiyama, Tokyo (JP); Atsushi Takehara, Kanagawa (JP); Ken Yoshida, Tokyo (JP); Shinji Kato, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 50 days.

(21) Appl. No.: 10/861,440

(22) Filed: Jun. 7, 2004

(65) Prior Publication Data

US 2005/0013636 A1 Jan. 20, 2005

(30) Foreign Application Priority Data

Jul. 2, 2003 (JP) ..... 2003-190291

(51) Int. Cl.
*G03G 15/16* (2006.01)

(52) U.S. Cl. ..... 399/303; 399/308

(58) Field of Classification Search ..... 399/302, 399/303, 308

See application file for complete search history.

(56) References Cited

U.S. PATENT DOCUMENTS 4,254,201 A 3/1981 Sawai et al.
4,528,937 A 7/1985 Kanno et al.
4,851,874 A 7/1989 Ogiyama
4,975,748 A 12/1990 Koinuma et al.
4,989,043 A 1/1991 Suzuki et al.
5,003,354 A 3/1991 Takamiya et al.
5,057,873 A 10/1991 Sawai et al.
5,208,211 A 5/1993 Kurotori et al.
5,231,452 A 7/1993 Murayama et al.
5,327,196 A 7/1994 Kato et al.
5,387,965 A 2/1995 Hasegawa et al.
5,410,339 A 4/1995 Bisaiji et al.
5,475,476 A 12/1995 Murai et al.

(Continued)

OTHER PUBLICATIONS

U.S. Appl. No. 11/276,666, filed Mar. 9, 2006, Takehara et al.

(Continued)

*Primary Examiner*—Quana Grainger
(74) *Attorney, Agent, or Firm*—Oblon, Spivak, McClelland, Maier & Neustadt, P.C.

(57) ABSTRACT

A method for evaluating an electric resistance member of an image forming apparatus which can maintain good image quality, without the occurrence of transfer defects such as insufficient transfer, even in a long-term use. An intermediate transfer belt of the image forming apparatus, which is evaluated based on a fluctuation characteristic of the resistivity in a period of continuous voltage application, is used. The absolute value $\Delta\rho s$ of the amount of changes in the surface resistivity of the intermediate transfer belt within 2 seconds to 100 seconds from the beginning of voltage application is 0.3 [Log(Ω/⊠)] or less, when the surface resistivity $\rho s$ is measured by applying a voltage of 500 V. The absolute value $\Delta\rho v$ of the amount of changes in the volume resistivity within 2 seconds to 100 seconds from the beginning of voltage application is 0.5 [Log(Ω·cm)] or less, when the volume resistivity $\rho v$ is measured by applying a voltage of 200 V.

11 Claims, 10 Drawing Sheets

U.S. PATENT DOCUMENTS 5,483,330 A 1/1996 Ogiyama et al.
5,493,382 A 2/1996 Takagaki et al.
5,571,457 A * 11/1996 Vreeland et al. ..... 252/519.21
5,604,575 A 2/1997 Takagaki et al.
5,671,470 A 9/1997 Maruta et al.
5,682,572 A 10/1997 Murai et al.
5,725,922 A * 3/1998 Nakamura et al. ..... 428/36.9
5,737,680 A 4/1998 Takagaki et al.
5,758,235 A 5/1998 Kosuge et al.
5,765,059 A 6/1998 Kosuge et al.
5,768,664 A 6/1998 Kosuge et al.
5,826,146 A 10/1998 Murata et al.
5,860,038 A 1/1999 Kato et al.
5,890,030 A 3/1999 Namekata et al.
5,970,276 A 10/1999 Kato
5,999,760 A * 12/1999 Suzuki et al. ..... 399/45
6,055,386 A 4/2000 Kato et al.
6,061,543 A 5/2000 Kayahara et al.
6,081,678 A 6/2000 Kato
6,141,520 A 10/2000 Kosuge
6,163,661 A 12/2000 Namekata et al.
6,195,519 B1 2/2001 Isobe et al.
6,212,351 B1 4/2001 Kawagoe et al.
6,249,304 B1 6/2001 Sawayama et al.
6,269,228 B1 7/2001 Kayahara et al.
6,292,206 B1 9/2001 Takehara et al.
6,295,438 B1 9/2001 Fujishiro et al.
6,334,039 B1 12/2001 Yoshinaga et al.
6,366,754 B1 4/2002 Sato et al.
6,405,002 B2 6/2002 Ogiyama et al.
6,489,020 B1 * 12/2002 Caruthers et al. ..... 428/327
6,505,024 B2 1/2003 Kayahara et al.
6,516,179 B1 2/2003 Sawai et al.
6,526,235 B2 2/2003 Kato
6,594,453 B2 7/2003 Kato
6,597,881 B2 7/2003 Hatori et al.
6,611,672 B2 8/2003 Aoki et al.
6,618,565 B2 9/2003 Tamiya et al.
6,654,574 B2 11/2003 Kayahara et al.
6,697,595 B2 2/2004 Kawagoe et al.
6,701,118 B2 3/2004 Kayahara et al.
6,741,821 B2 5/2004 Sugino et al.
6,768,892 B2 7/2004 Sawai
6,778,794 B2 8/2004 Kayahara
6,782,227 B2 8/2004 Ishibashi et al.
6,785,500 B2 8/2004 Takahashi et al.

OTHER PUBLICATIONS

U.S. Appl. No. 11/289,267, filed Nov. 30, 2005, Hashimoto et al.
U.S. Appl. No. 11/608,599, filed Dec. 8, 2006, Sawai.

* cited by examiner

FIG. 10

| SURFACE RESISTANCE | | | | CONSTANT VOLTAGE CONTROL | | CONSTANT CURRENT CONTROL | |
|---|---|---|---|---|---|---|---|
| | 2 sec VALUE | 100 sec VALUE | Δρs | CONTINUOUS 100 COPIES | 10,000 COPIES | CONTINUOUS 100 COPIES | 10,000 COPIES |
| BELT No3 | 11.00 | 11.54 | 0.55 | × : DENSITY DECREASE | × : DENSITY DECREASE | × : DENSITY DECREASE | × : DENSITY DECREASE |
| BELT No6 | 10.23 | 10.57 | 0.34 | × : DENSITY DECREASE | × : DENSITY DECREASE | × : DENSITY DECREASE | Δ× : DENSITY DECREASE |
| BELT No1 | 10.52 | 10.80 | 0.28 | O | O | O | O |
| BELT No2 | 9.96 | 9.97 | 0.01 | O | O | O | O |
| BELT No4 | 10.70 | 10.50 | −0.20 | O | O | O | O |
| BELT No7 | 10.41 | 10.12 | −0.29 | O | O | O | O |
| BELT No5 | 11.00 | 10.62 | −0.38 | × : RESIDUAL IMAGE | × : RESIDUAL IMAGE | × : RESIDUAL IMAGE DENSITY DECREASE | × : RESIDUAL IMAGE DENSITY DECREASE |

FIG. 11

| VOLUME RESISTANCE | | | | CONSTANT VOLTAGE CONTROL | | CONSTANT CURRENT CONTROL | |
|---|---|---|---|---|---|---|---|
| | 2 SEC VALUE | 100 sec VALUE | | CONTINUOUS 100 COPIES | 10,000 COPIES | CONTINUOUS 100 COPIES | 10,000 COPIES |
| BELT No11 | 12.09 | 13.02 | 0.93 | X : DENSITY DECREASE | X : DENSITY DECREASE | X : DENSITY DECREASE | X : DENSITY DECREASE |
| BELT No9 | 9.71 | 10.47 | 0.76 | X : DENSITY DECREASE | X : DENSITY DECREASE RESIDUAL IMAGE | X : DENSITY DECREASE | X : DENSITY DECREASE |
| BELT No14 | 8.7 | 9.26 | 0.56 | O | Δ | O | Δ |
| BELT No8 | 10.63 | 11.10 | 0.47 | O | O | O | O |
| BELT No10 | 8.44 | 8.62 | 0.18 | O | O | O | O |
| BELT No12 | 9.30 | 8.88 | -0.42 | O | O | O | O |
| BELT No15 | 10.45 | 9.91 | -0.54 | X : EXCESSIVE TRANSFER | X : EXCESSIVE TRANSFER RESIDUAL IMAGE | X : RESIDUAL IMAGE | X : RESIDUAL IMAGE |
| BELT No13 | 9.10 | 8.42 | -0.88 | X : EXCESSIVE TRANSFER | X : EXCESSIVE TRANSFER RESIDUAL IMAGE | X : RESIDUA IMAGE | X : RESIDUAL IMAGE |

METHOD FOR EVALUATING CHANGES IN RESISTANCE OF ELECTRIC RESISTANCE MEMBER AND IMAGE FORMING APPARATUS USING SAME

BACKGROUND OF THE INVENTION

1. Field of the Invention

The present invention relates to a method for evaluating changes in the resistance of an electric resistance member, and more particularly to a method for evaluating the electric charge carrying member of an image forming apparatus.

2. Description of the Related Art

Image forming apparatuses such as copiers, facsimile devices, and printers are provided with an image carrier, a latent image carrier, and a developing agent carrier as members that are electrified and carry an electric charge. Specific examples of such carriers include a photosensitive body, a developing roller, and a transfer member. In case of image forming apparatuses comprising multiple toners, such as color imaging apparatuses, a transfer belt is used as the transfer member.

Tandem color image forming apparatuses are known as the image forming apparatuses having a transfer belt. The tandem color image forming apparatuses are provided with a plurality of photosensitive bodies disposed along the surface of the transfer belt as image carriers. Such a transfer belt is provided with an electric charge with transfer bias application means and carries the charge. A method of using toner images of multiple colors which are formed on the photosensitive bodies to obtain a color image directly on the transfer material which is supported and transported by the transfer belt and a method of indirectly transferring a toner image on a transfer belt as an intermediate transfer belt and then obtaining a color image by transferring the image to the transfer material are known.

Constant voltage control means which maintains a constant voltage applied to the image carrier and constant current control means which maintains a constant current flowing in the image carrier are employed as transfer bias application means for providing the transfer belt with an electric charge. Values of the voltage and current which are controlled vary depending on the surface resistivity or volume resistivity of the belt. For this reason, the resistance value of the belt is required to be uniform in the circumferential direction and the dependence thereof on environment and voltage has to be low.

However, the following problems were associated with the transfer belts. Thus, when the transfer belt was continuously provided with an electric charge for a long time, the charge remained on the boundary surface of the transfer belt and the resistance value of the transfer belt increased. Furthermore, the transfer belt was degraded, for example, by an electric discharge between an image carrier and a transfer roller, which resulted in the formation of a conductive path on the transfer belt and decreased the resistance value of the transfer belt. Thus, because the resistance value of the transfer belt changes with time, the resistivity thereof will change if such a belt is used for a long time. As a result, the quantity of electric charge supplied to the transfer belt could be insufficient and the image density could decrease due to such an insufficient transfer or, conversely, the quantity of electric charge supplied to the transfer belt could be too high, causing partial discharge and transfer loss which corresponds to the discharge.

Furthermore, when changes in the resistance value of such a transfer belt with time were measured, a test comprising a step of applying a voltage within a fixed interval to the belt was repeated hundreds of times to measure the changes in the resistance value of the transfer belt with time. For this reason, a long time was required to determine the changes in the resistance value of one belt with time.

A differential constant current control method that was conducted so as to obtain a constant difference between the output current from a transfer bias source and a current returning via the transfer belt and a method for preventing image degradation by a constant voltage control based on the correction of current value, as described, for example, in Japanese Patent Applications Laid-open Nos. 2001-209233, 2000-147849, 2001-125338, and H8-194389, have been employed when the volume resistivity of the transfer belt has changed. However, when the surface resistivity of the transfer belt changes with time, the leak quantity of electric current in the circumferential direction of. the belt varies. As a result, a problem associated with power sources for supplying a bias to bias application means in each transfer location rises, for example, in case of tandem color image forming apparatuses with four transfer locations. The problem is that even if the leaking current is detected from transfer locations of the transfer belt, it is unclear from which location the current has leaked. As a result, it was not clear which power source output has to be controlled and how it should be done, and the differential constant current control or constant voltage control based on current value correction could not be used.

Problems associated with the transfer belt as a transfer member were described above, but problems caused by changes in the resistance value with time are also associated with electric resistance members. In particular, the problems are especially easily caused by changes in the resistance value of a photosensitive body, which is a change carrying member of the image forming apparatus, or a development roller.

SUMMARY OF THE INVENTION

The present invention was created in view of the above-described difficulties. It is an object of the present invention to provide an image forming apparatus equipped with an electric resistance member which can maintain good image quality, without transfer defects such as insufficient transfer, even in a long-term use, based on utilization of a simple measurement method.

In accordance with the present invention, there is provided a method for evaluating changes in the resistance of an electric resistance member. The method comprises applying a voltage continuously to the electric resistance member, and evaluating changes in the resistivity with time based on a fluctuation characteristic of the resistivity in a continuous voltage application interval.

In accordance with the present invention, there is also provided an image forming apparatus which comprises an image carrying body, and a transfer device for transferring a developing agent present on the image carrying body onto a transfer surface of a transfer member with electric field application means. At least said transfer member comprises an electric charge carrying member evaluated by the resistance change evaluation method. The resistance change evaluation method comprises applying a voltage continuously to the electric resistance member, and evaluating changes in the resistivity with time based on a fluctuation characteristic of the resistivity in a continuous voltage application interval.

BRIEF DESCRIPTION OF THE DRAWINGS

The above and other objects, features, and advantages of the present invention will become more apparent from the following detailed description taken with the accompanying drawings in which:

FIG. 10 illustrates the results obtained with the constant voltage control and constant current control in making 100 copies in a continuous mode and 10,000 copies with belts Nos. 1-7; and FIG. 11 illustrates the results obtained with the constant voltage control and constant current control in making 100 copies in a continuous mode and 10,000 copies with belts Nos. 8-15.

DESCRIPTION OF THE PREFERRED EMBODIMENTS

Respective embodiments in which the present invention was applied to an electrophotographic copier, which is an image forming apparatus, will be described hereinbelow.

Figure 1:
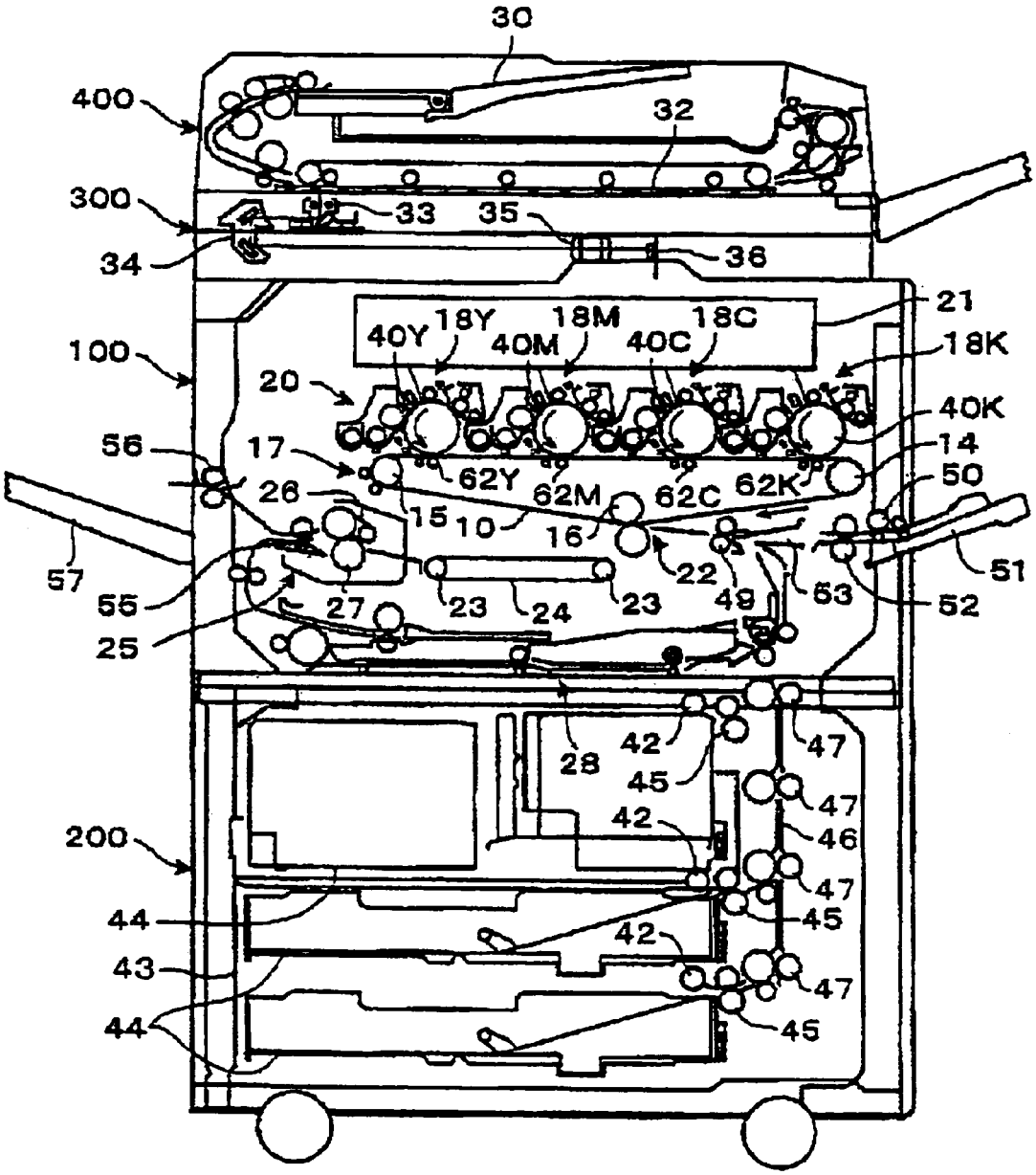
FIG. 1 illustrates a schematic configuration of the image forming apparatus of an embodiment of the present invention.

FIG. 1 illustrates schematically the configuration of a tandem-type color electrophotographic copying apparatus of a direct transfer system of an embodiment of the present invention. The reference numeral 100 in the figure stands for copying apparatus body, 200—a paper supply table which carries the apparatus body, 300—a scanner mounted on the copying apparatus body 100, and 400—an automatic document feeder (ADF) further mounted thereon.

An intermediate transfer belt 10 of an endless belt type is provided in the central part of the copying apparatus body 100. As shown in FIG. 1, the belt is stretched over three support rollers 14, 15, and 16 and allows for clockwise (as shown in the figure) rotary transportation. An intermediate belt cleaning unit 17 for removing the residual toner which remains on the intermediate transfer belt 10 after the image transfer is provided at the left side of the second support roller 15 of the three support rollers 14, 15, and 16.

Four (yellow, cyan, magenta, and black) image forming means 18 are disposed transversely in a row along the belt transportation direction above the intermediate transfer belt 10 stretched over the first support roller 14 and second support roller 15. As a result, a tandem image forming unit 20 is obtained.

An exposure unit 21 is provided further above this tandem image forming unit 20, as shown in FIG. 1.

On the other hand, a secondary copying unit 22 is provided on the side opposite to that of the tandem image forming unit 20, so that the two units sandwich the intermediate transfer belt 10. The secondary transfer unit 22, as shown in the figure, comprises a secondary transfer belt 24 which is an endless belt stretched over two rollers 23. This secondary transfer unit is so. disposed as to be pressed against the third support roller 16 via the intermediate transfer belt 10, and transfers the image present on the intermediate transfer belt 10 to a sheet.

A fixing unit 25 for fixing the transferred image present on the sheet is provided on the side of the secondary transfer unit 22. In the fixing unit 25, a pressure roller 27 is pressed against a fixing belt 26 which is an endless belt.

The above-described secondary transfer unit 22 also has a sheet transportation function of transporting the sheets after the image has been transferred thereto to the fixing unit 25. It goes without saying, that transfer rollers or a contactless charger may be disposed as the secondary transfer unit 22. In this case, it is difficult to provide the unit with the sheet transportation function.

A sheet turn-over unit 28 for turning over a sheet on which the images have to be recorded on both sides is provided parallel to the above-mentioned tandem image forming unit 20 below the aforementioned secondary transfer unit 22 and fixing unit 25.

When copying is carried out by using a tandem-type color electronic copier of the above-describes structure, an original is set on a document stand 30 of an automatic document feeder 400. Alternatively, the automatic document feeder 400 is opened, an original is set on a contact glass 32 of the scanner 300, and the automatic document feeder 400 is closed, thereby pressing the original. If a start switch (not shown in the figure) is then pushed, when the original was set in the automatic document feeder 400, the original is transported and moved on the contact glass 32. When the original was set on the contact glass 32, the scanner 300 is immediately driven and a first traveling body 33 and second traveling body 34 are moved. Light is emitted from a light source in the first traveling body 33, the light reflected from the original surface is further reflected toward the second traveling body 34, reflected by the mirror of the second traveling body 34, and inputted in a read sensor 36 via an image converging lens 35, and the contents of the original is read.

Further, if a start switch (not shown in the figure) is pushed, one of the support rollers 14, 15, and 16 is rotary driven with a drive motor (not shown in the figure), other two support rollers are driven and rotated, and the intermediate transfer belt 10 is rotary transported. At the same time, black, yellow, magenta, and cyan monochromatic images are formed on photosensitive bodies 40 by each image forming means 18 as the photosensitive bodies 40 are rotated. As the intermediate transfer belt 10 moves, those monochromatic images are successively transferred thereby forming a composite color image on the intermediate transfer belt 10.

On the other hand, if a start switch (no shown in the figure) is pushed, one of the paper feed rollers 42 of the paper feed table 200 is selectively rotated, and a sheet is drawn out from one of paper feed cassettes 44 provided in a multistage fashion in a paper bank 43. The sheets are then separated one by one with a separation roller 45, introduced in a paper feed path 46, transported with a transportation roller 47, guided in a paper feed path 48 in the copier body 100, knocked against a resist roller 49, and stopped.

Alternatively, a paper feed roller 50 is rotated, a sheet located on a manual feed tray 51 is drawn out, the sheets are then separated one by one with a separation roller 52, introduced in a manual paper feed path 53, similarly knocked against a resist roller 49, and stopped.

A resist roller 49 is rotated by matching timing with the composite color image on the intermediate transfer belt 10, a sheet is supplied between the intermediate transfer belt 10 and the secondary transfer unit 22, the image is transferred in the secondary transfer unit 22, and a color image is recorded on the sheet.

The sheet after this image transfer is transported with the secondary transfer unit 22 and fed into the fixing unit 25. In the fixing unit 25, the transferred image is fixed by applying heat and pressure, and the sheet is then reoriented with a reorientation hook 55, released with a release roller 56, and stacked on an output tray 57. Alternatively, the sheet is reoriented with the reorientation hook 55, introduced into the sheet turn-over unit 28, turned over, and again guided to the transfer position. After an image has been recorded on the rear surface, the sheet is released onto the output tray 57 with the release roller 56.

On the other hand, the intermediate transfer belt 10 after the image transfer procedure is treated in the intermediate transfer belt cleaning unit 17 where the residual toner remaining on the intermediate transfer belt 10 after the image transfer is removed. The intermediate transfer belt is then employed for forming another image with the tandem image forming unit 20.

The resist roller 49 is most often used in a grounded state, but a bias voltage can be applied thereto to remove paper dust from the sheet.

Figure 2:
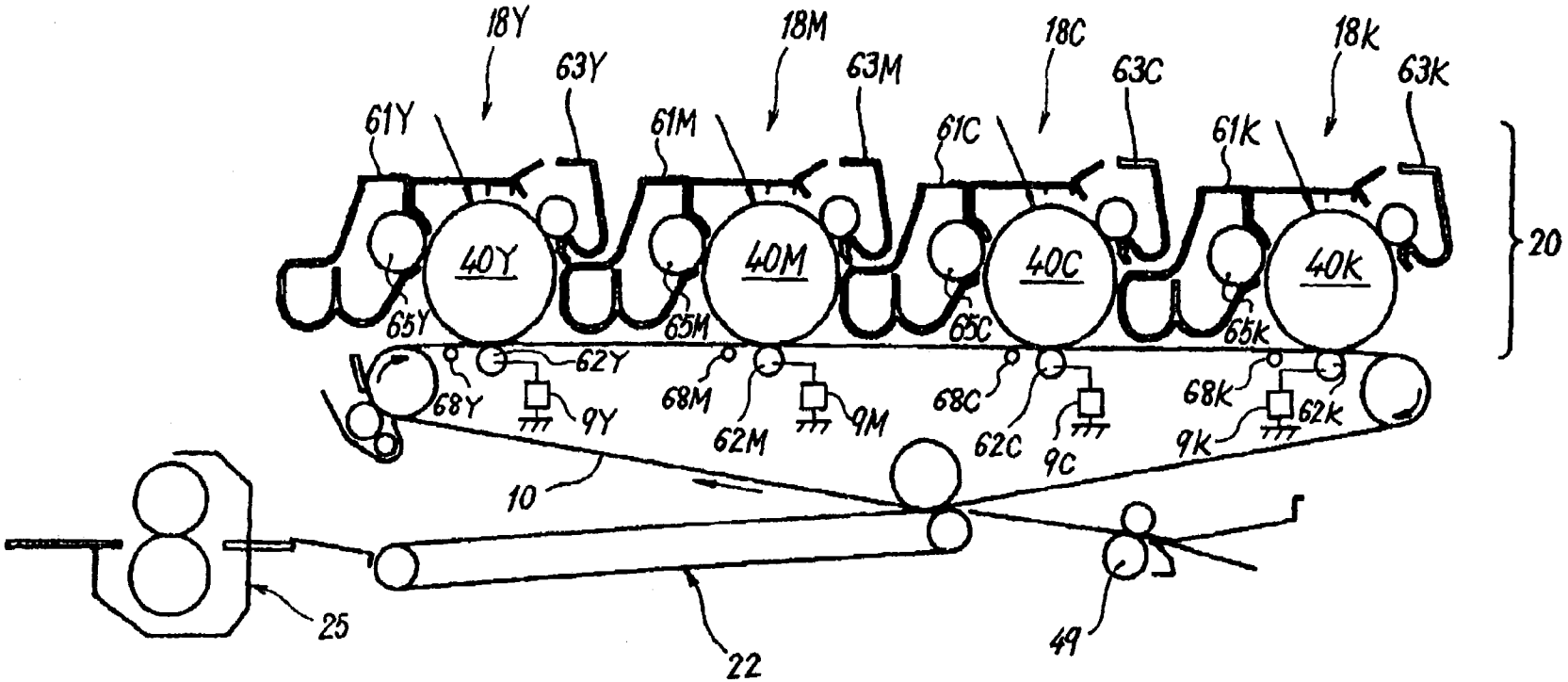
FIG. 2 is an enlarged view illustrating the main components of the image forming unit of the image forming apparatus of the first embodiment of the present invention.

FIG. 2 illustrates the structure of the main components of the image forming portion of the tandem image forming unit 20. In the above-described tandem image forming unit 20, individual image forming means 18 comprise primary transfer units 62 as primary transfer means at the photosensitive bodies 40 serving as drum-like image carriers as shown in FIG. 2. The primary transfer units 62 abut against the primary transfer nip portions where the intermediate transfer belt 10 is in contact with the photosensitive bodies 40.

Transfer rollers 62Y, 62M, 62C, 62K are provided as electric field application means for forming a transfer electric field in each transfer position, so as to be in contact with the rear surface of the intermediate transfer belt 10 in the position opposite the photosensitive body. A transfer bias is applied thereto from transfer bias power sources 9Y, 9M, 9C, and 9K.

Under the effect of this applied transfer bias, a transfer charge is provided to the intermediate transfer belt 10 and a transfer electric field of prescribed intensity is formed between the surface of the photosensitive body 40 and intermediate transfer belt 10 in each transfer position. Furthermore, backup rollers 68 are provided to maintain adequate contact between the photosensitive body 40 and intermediate transfer belt 10 in the region where the aforementioned transfer is to be conducted and to obtain the optimum transfer nip. Constant current power sources that maintain a constant current flowing to the photosensitive body are used for the transfer bias power sources 9. When the constant current power sources are used, the correct transfer current is ensured despite certain fluctuations in the resistivity of the intermediate transfer belt 10. Therefore, the allowed range of resistance fluctuations of the belt can be expanded.

Further, a spherical toner is preferably used as the toner employed in the present embodiment. In the present embodiment, a transfer roller is provided so as to be in contact with the rear surface of the intermediate transfer belt 10 in a position opposite the photosensitive body 40. Therefore, the transfer pressure sometimes can increase. If the transfer pressure increases, toner particles cohere, easily causing thinning of the letters. Therefore, using spherical toner with low cohesiveness makes it possible to obtain good image without thinning of the letters.

The intermediate transfer belt 10 used in the present embodiment will be described below.

The intermediate transfer belt used in the present embodiment was evaluated based on the fluctuation characteristic of resistivity within the continuous voltage application period. More specifically, the absolute value $\Delta\rho s$ of the amount of changes in the surface resistivity within 2 seconds to 100 seconds from the beginning of voltage application is 0.3 [Log(Ω/⊠)] or less, when measurements are conducted by applying a voltage of 500 V. Further, the intermediate transfer belt is used in which the absolute value $\Delta\rho v$ of the amount of changes in the volume resistivity $\rho v$ within 2 seconds to 100 seconds from the beginning of voltage application is 0.5 [Log(Ω·cm)] or less, when measurements are conducted by applying a voltage of 200 V.

Further, the intermediate transfer belt used in the present embodiment is a monolayer belt formed from a polyimide resin comprising at least carbon black as an electrically conductive agent. Employing carbon black as an electrically conductive agent makes it possible to increase dispersivity and reduce the volume resistivity with respect to the surface resistivity. Further, because a monolayer belt is used, accumulation of electric charge is prevented and the increase in resistivity can be reduced.

Further, the surface resistivity of the intermediate transfer belt is preferably 9-12 [Log(Ω/⊠)], more preferably 10-11.5 [Log(Ω/⊠)]. The volume resistivity of the belt is set within a range of 7-10 [Log(Ω·cm)], more preferably 8-9.5 [Log (Ω·cm)]. If the surface resistivity is less than 9 [Log(Ω/⊠)], the ratio of electric current flowing to the belt surface is increased and a sufficient transfer electric field cannot be obtained. If the surface resistivity exceeds 12 [Log(Ω/⊠)], the electric charge accumulates on the belt surface, thereby causing abnormal discharge. On the other hand, if the volume resistivity is less than 7 [Log(Ω·cm)], leak of electric current easily occurs. Further, if the volume resistivity is higher than 12 [Log(Ω/⊠)], the electric current flow is inhibited and the transfer electric field is difficult to form with good efficiency. Therefore, a high-voltage power source unit is required and cost is increased.

The present embodiment employed the intermediate transfer belt that was evaluated based on the fluctuation characteristic of the resistivity in the continuous voltage application interval, but the above-described evaluation method may be also applied to a development roller or photosensitive bodies which are also the electric charge carrying members.

A method for measuring the surface resistivity of the intermediate transfer belt used in the present embodiment will be described below.

Figure 3:
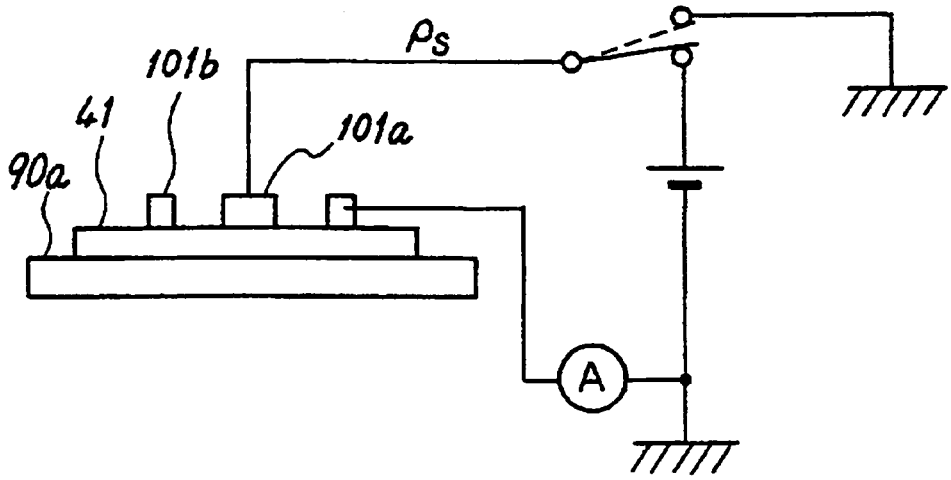
FIG. 3 illustrates a schematic configuration of the measurement apparatus for continuously measuring the surface resistivity ρs.

FIG. 3 illustrates schematically the structure of the measurement device for continuously measuring the surface resistivity ρs of the intermediate transfer belt. When the surface resistivity ρs is measured, a sample member 41 formed of the same material and under the same conditions as the intermediate transfer belt is placed on an insulating plate 90*a*. A probe 101 comprising an inner electrode 101*a* and a ring electrode 101*b* located at a fixed distance from the inner electrode is disposed above the sample member 41. A voltage of 500 V is applied to the inner electrode 101*a*, an electric current flowing in the ring electrode 101*b* is measured with an ammeter, and the surface resistivity ρs relating to 2 seconds and 100 seconds after the beginning of voltage application is found.

Figure 4:
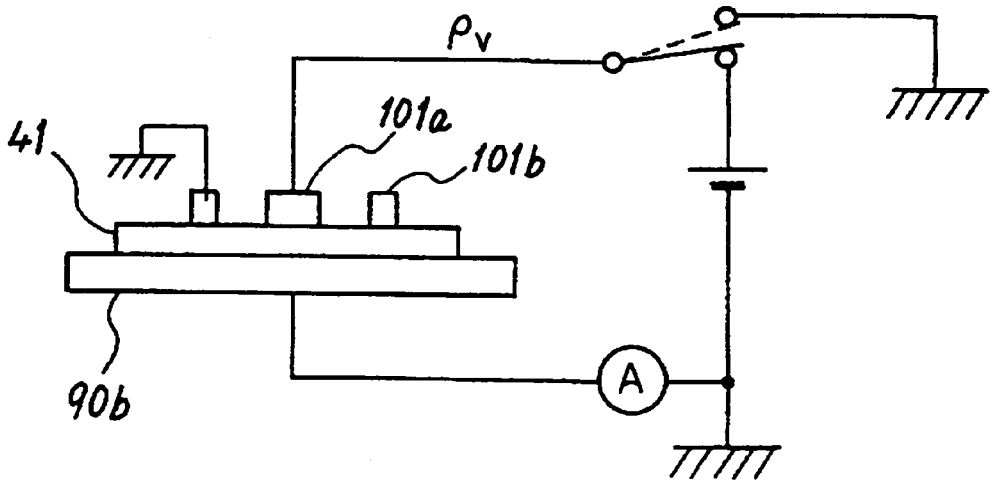
FIG. 4 illustrates a schematic configuration of the measurement apparatus for continuously measuring the volume resistivity ρv.

FIG. 4 illustrates schematically the structure of the measurement device for continuously measuring the volume resistivity ρv of the intermediate transfer belt. The measurements of the volume resistivity ρv are similarly conducted by placing a sample member 41 formed of the same material and under the same conditions as the intermediate transfer belt on a counter-electrode 91*b*. A probe 101 comprising an inner electrode 101*a* and a ring electrode 101*b* located at a fixed distance from the inner electrode is disposed above the sample member 41. The ring electrode 101*b* is grounded. A voltage of 200 V is applied to the inner electrode 101*a*, an electric current flowing in the counter-electrode 90*b* is measured with an ammeter, and the volume resistivity ρv relating to 2 seconds and 100 seconds after the beginning of voltage application is found.

An URS probe (MCP-HTP14) manufactured by Mitsubishi Kagaku K.K. was used as the aforementioned probe, and COR-A-TROL (610C) manufactured by Trek Co., was used as a constant voltage power source for applying voltage to the inner electrode. Furthermore, a Digital Electrometer TR8652 manufactured by Advan Test Co. was used as the ammeter.

In those measurement devices, the measurement voltage and measurement time can be freely set. Furthermore, an electrostatic charge can be removed from the sample member by grounding the electrodes.

Changes in the electric resistivity that take place in the sample member (electric resistance member) with time can be thus evaluated by measuring the absolute values of Δρs and Δρv of the difference in the surface resistivity and volume resistivity by continuous voltage application.

Characteristics of the intermediate transfer belt which is preferably used in the embodiments will be explained hereinbelow based on examples.

EXAMPLE 1

The relationship between the fluctuation characteristic of the surface resistivity in the continuous voltage application interval and the effect produced on the image in continuous copying and timed copying was studied.

Figure 5:
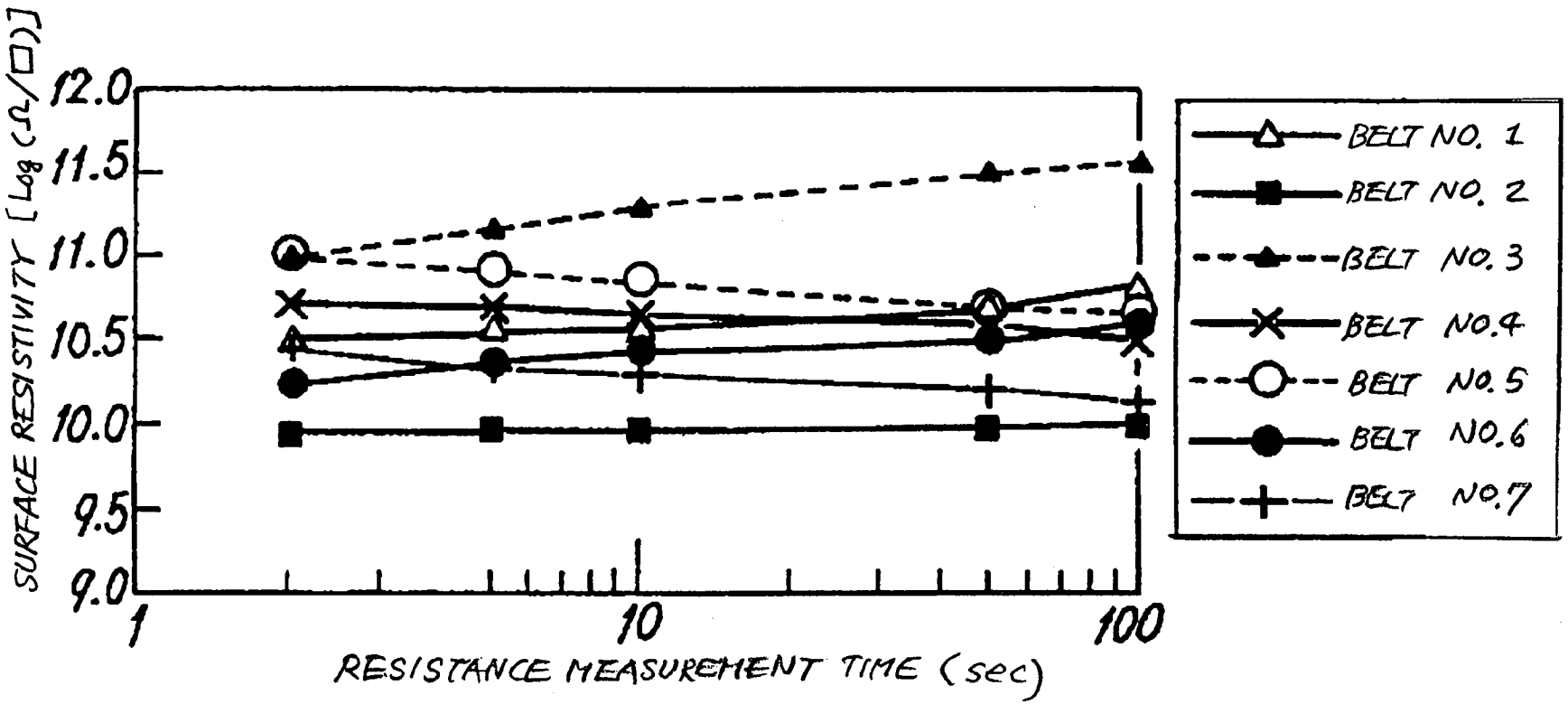
FIG. 5 illustrates the relationship between the voltage application time and surface resistivity in belts Nos. 1-7.

First, intermediate transfer belts of seven types were fabricated and changes in the surface resistivity within a 2-100 seconds interval were studied by using the above-described method for measuring the surface resistivity. The results are shown in FIG. 5.

The intermediate transfer belts of seven types that were used for the test were fabricated by the following method. Belts Nos. 1-4, 6, 7 were monolayer endless belts composed of a polyimide resin. More specifically, they were fabricated by the following method. Carbon black was dispersed in a solution of a polyamic acid, the dispersion was poured into a cylindrical mold and heated to a temperature of 100-150° C., while rotating the cylindrical mold. As a result, the solvent was evaporated and a film was grown. The film was then primary cured at a temperature of 250-300° C. and peeled off from the cylindrical mold. The peeled film was placed on an iron core heated to a temperature of 300-400° C., a polyimidization reaction was conducted, while the film was stretched, and a polyimide film was produced. Monolayer endless belts composed of a polyimide resin were formed by cutting this polyimide film to an appropriate size. The thickness of each belt was 80 μm. The belts were produced under conditions that differed in the content ratio of carbon black or dispersion state.

The belt No. 5 was a monolayer endless belt fabricated by dispersing carbon black in a thermoplastic polycarbonate resin and extruding with an extrusion molding machine. The belt thickness was 150 μm.

The intermediate transfer belts of the above-described seven types were installed in the image forming apparatus shown in FIG. 1 and 100 (continuous mode) and 10,000 copies were made. The transfer bias control was conducted by both the constant voltage and constant current control. The results are shown in FIG. 10. When 100 copies were continuously made, the evaluation of test results was conducted by visually comparing the quality of the image of the $100^{th}$ copy to that of the $1^{st}$ copy. When 10,000 copies were made, the image of the $10{,}000^{th}$ copy was visually evaluated.

In the transfer belt No. 3 with an absolute value Δρs of the amount of changes in the surface resistivity of 0.55, density decrease occurred under both the constant voltage control and the constant current control when 100 copies were continuously made. This was apparently because, when the constant voltage control was employed, the surface resistance increased and the electric current could not flow on the belt surface. This was apparently why the necessary charge was not supplied and density decrease was caused by insufficient transfer. On the other hand, in case of constant current control, voltage increased following the increase in resistance, and when the voltage reached the upper limit of the power source voltage, the voltage necessary for electric field formation could not be obtained, causing decrease in density. Furthermore, when the constant current control was conducted, the transfer voltage increased, causing peeling discharge in the gaps upstream and downstream of the transfer nips and image distortions such as transfer dirt were also observed.

Further, when the surface resistivity μs was measured after making 10,000 copies with the belt No. 3, the surface resistivity increased by more than an order of magnitude with respect to the initial value. For this reason, with 10,000 copies, too, the decrease in density occurred under both the constant current control and the constant voltage control, for the reasons similar to those described above. If the surface resistance rises by more than an order of magnitude with respect to the initial value, an abnormal discharge can occur between the belt surface (front and rear) and adjacent members, thereby causing abnormal images.

Further, in the belt No. 5, the absolute value Δρs of the amount of changes in the surface resistivity was −0.38 and the surface resistivity decreased. This was apparently because a conductive path was formed on the transfer belt and sections appeared in which electric current could easily flow to the periphery of the belt, due to the dispersed state of the electrically conductive agent in the transfer belt. When 100 copies were continuously made, the decrease in density and residual images were observed under the constant current control, and the presence of residual images was confirmed under the constant voltage control.

The decrease in density under the constant current control is apparently due to an insufficient transfer caused by the increase in the ratio of electric current flowing to the periphery of the transfer below, an insufficient supply of electric charge, and the decrease in transfer voltage, those effects resulting from the decrease in the surface resistivity.

Further, residual images under the constant current and constant voltage control are apparently caused by the following effects. Because the electric current can easily flow in the circumferential direction of the belt, the current easily flows to portions with a low resistance. More specifically, the current flows to portions with a low resistance rather than to the toner portions which have a high resistance. As a result, the belt resistance outside the toner portions decreased. Therefore, the belt resistance becomes nonuniform causing a transfer non-uniformity. Such a prehistory apparently affects the next copied image and manifest itself as a residual image on the next copy. In case of 10,000 copies, too, a similar reduction of the surface resistivity occurred and the residual images or density reduction were observed due to the effects similar to those encountered in continuous copying of 100 copies.

Further, in a transfer belt with an absolute value Δρs of the amount of changes in the surface resistivity of 0.3 or less, the amount of changes in the surface resistance after 10,000 copies was as small as 0.5 or less, and abnormal images were not observed under both the constant current and the constant voltage control.

The above-described facts suggest the following. Copied images without image distortions can be obtained within a long interval if the image forming apparatus uses an intermediate transfer belt in which the absolute value Δρs of the amount of changes in the surface resistivity within 2 seconds to 100 seconds from the beginning of voltage application is 0.3 or less when a voltage of 500 V is continuously applied.

EXAMPLE 2

The control by the same voltage value and the control by the same current value were studied on the belts Nos. 1, 2, 4, 7 with a small absolute value Δρs of the amount of changes in the surface resistivity, which showed good results in the above-described tests. The voltage value and current value for the transfer bias were determined from the transfer ability observed when a belt with a standard surface resistance of 11 [Log(Ω/⊠)] was used. As a result, when the belts Nos. 1, 2, 4, and 7 were constant voltage controlled by the same voltage value, the belts Nos. 1 and 7 were found to demonstrate insufficient or excessive transfer. On the other hand, when the belts Nos. 1, 2, 4, and 7 were constant current controlled by the same current value, good images were obtained for the belts Nos. 1, 2, 4, and 7.

The above-described results demonstrated that the constant current control allows for a wider tolerance with respect to resistance fluctuations than the constant voltage control.

EXAMPLE 3

Changes in the images caused by the position of transfer roller were studied by varying the position of the transfer roller.

Figure 6:
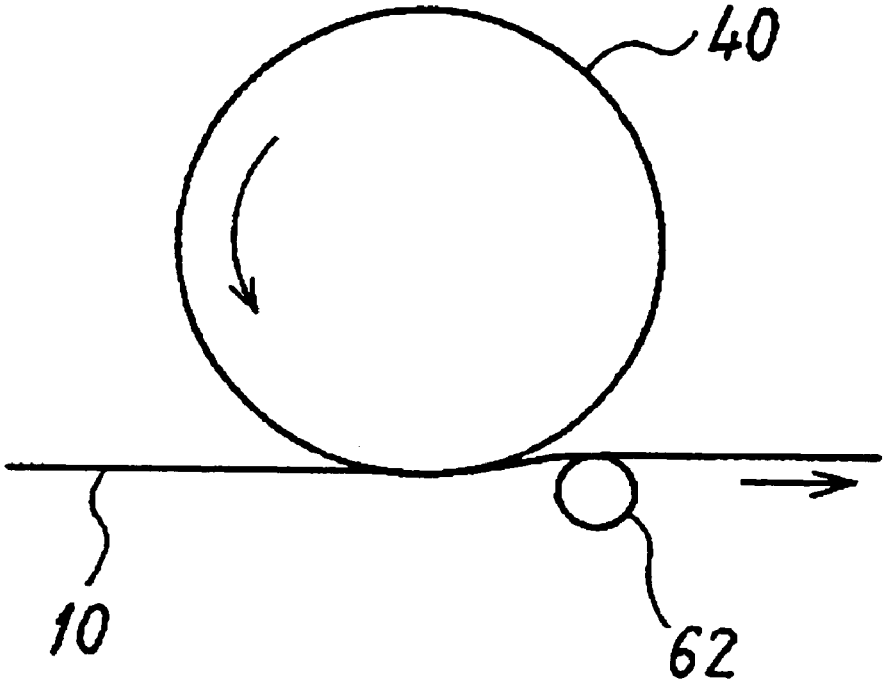
FIG. 6 is an enlarged view illustrating part of the image forming unit of the image forming apparatus with changed position of a transfer roller.

First, the belts used in Example 1 were installed as the intermediate transfer belt 10 in the image forming apparatus in which the transfer roller 62 was provided in the position shown in FIG. 6, and one copy was made under the constant current control.

As a result, a transfer non-uniformity caused by abnormal charge was confirmed for all the belts other than the belt No. 2. In this case, the transfer roller 62 was far from the transfer nip portion, as follows from FIG. 6. This is apparently why an electric field in the gap close to the nip exit increased, causing an abnormal discharge in this region. Furthermore, in the belts other than the belt No. 2, the surface resistivity assumed a high value of 10 [Log(Ω/⊠)] and the electric current could not flow easily in the circumferential direction of the belt. As a result, the applied voltage increased due to the constant current control, and an abnormal discharge occurred in the gap close to the nip exit.

Then, a similar test was conducted in the image forming apparatus shown in FIG. 1. As a result, no transfer non-uniformity caused by an abnormal discharge could be confirmed. This result can be explained as follows. Because the transfer roller was provided in a position opposite the photosensitive body, in the so-called transfer nip region, the transfer bias could be directionally applied to the transfer nip portion. Therefore, a constant current could flow almost without any increase in voltage, regardless of the surface resistance. As a result, the gap discharge did not occur. Furthermore, a voltage applied to the transfer roller was reduced to a low level. A margin exists for the limit of transfer bias voltage source, and in case of the constant current control, the surface resistance increases and it is possible to cope even with a high voltage requirement.

The above-described results demonstrated that good images can be obtained by providing the transfer roller in the transfer nip region.

EXAMPLE 4

The relationship between the fluctuation characteristic of the volume resistivity in the continuous voltage application interval and the effect produced on the image in continuous copying and timed copying was studied.

Figure 7:
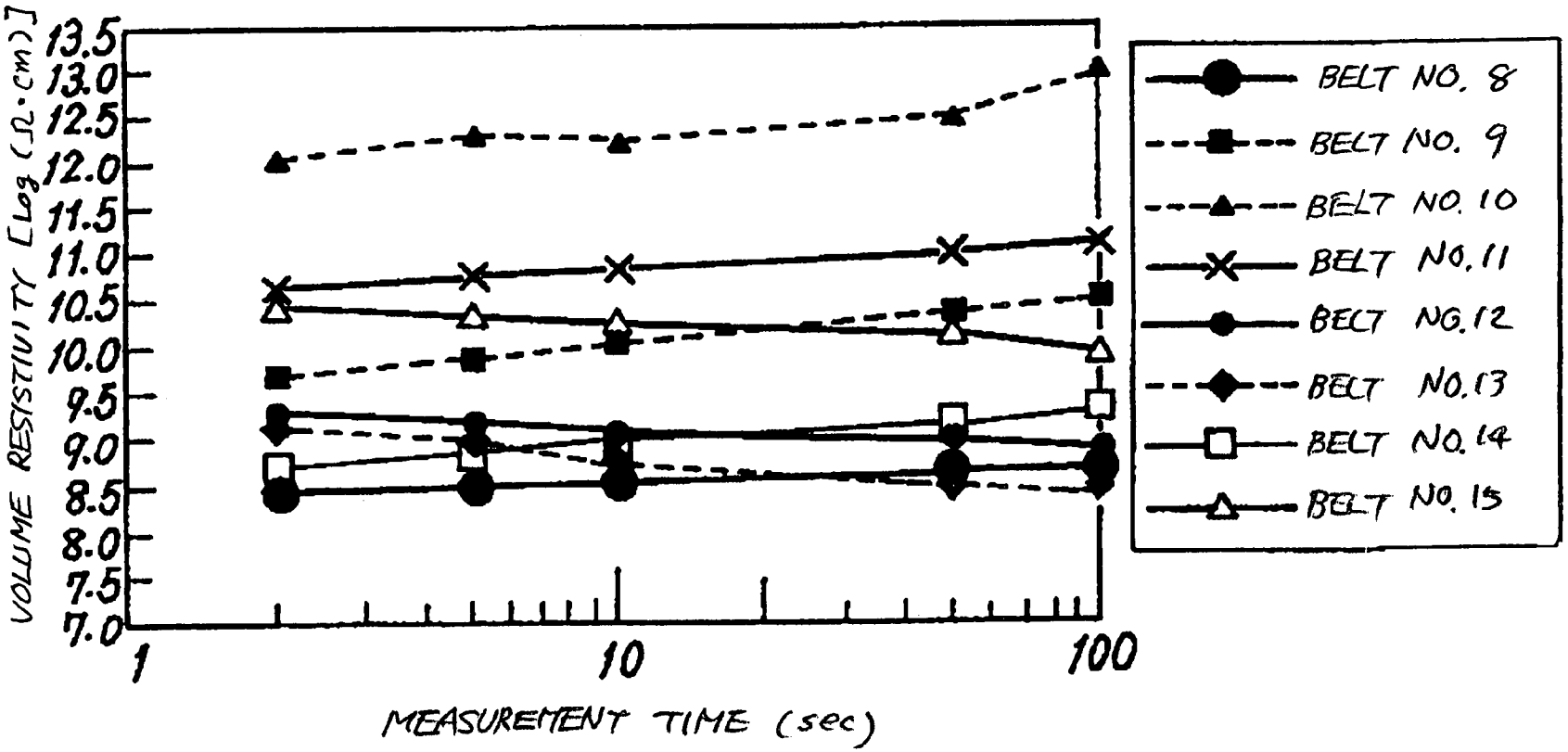
FIG. 7 illustrates the relationship between the voltage application time and volume resistivity in belts Nos. 8-15.

First, intermediate transfer belts of eight types were fabricated and changes in the surface resistivity within a 2-100 seconds interval were studied by using the above-described method for measuring the volume resistivity. The results are shown in FIG. 7.

The intermediate transfer belts of eight types that were used for the test were fabricated by the following method. The belts Nos. 8-10, 12, 14 were monolayer endless belts composed of a polyimide resin. They were fabricated by the same method as the belts Nos. 1-4, 6, and 7 of the above-described Example 1. The belts Nos. 8-10, 12, 14 had different contents and dispersion state of carbon black. The thickness of each belt was 80 μm.

The belt No. 13 was a monolayer endless belt fabricated by dispersing carbon black in a thermoplastic polycarbonate resin and extruding with an extrusion molding machine. The belt thickness was 150 μm.

The belt No. 15 was a monolayer endless belt fabricated by dispersing carbon black in a thermoplastic ETFE resin and extruding with an extrusion molding machine. The belt thickness was 150 μm.

The belt No. 11 was a laminated belt. The inner layer was an endless belt fabricated by a dipping in a PVDF solution having carbon black dispersed therein. The surface layer was from a fluororesin. The inner layer had a thickness of 150 μm and the surface layer had a thickness of 5 μm.

The intermediate transfer belts of the aforementioned eight types were installed in the image forming apparatus shown in FIG. 1 and 100 copies (continuous mode) and 10,000 copies were made. The test was conducted under both the constant voltage control and the constant current control of transfer bias. The results are shown in FIG. 11. When 100 copies were continuously made, the evaluation of test results was conducted by visually comparing the quality of the image of the $100^{th}$ copy to that of the $1^{st}$ copy. When 10,000 copies were made, the image of the $10{,}000^{th}$ copy was visually evaluated.

A high absolute value Δρv of the amount of changes in the volume resistivity in the belt No. 11 is due to the fact that the surface layer in the laminated belt had a high resistance. In the laminated belts with a high-resistance layer, electric charge accumulates with time at the boundary of the high-resistance layer and the resistance rises. As a result of such an increase in resistance, under the constant voltage control, a density decrease occurred when 100 copies were continuously made, and under the constant current control, residual images were observed. This was apparently because, when the constant voltage control was employed, the flow of transfer current was inhibited, sufficient transfer electric filed could not be obtained, and insufficient transfer caused the decrease in density. In case of the constant current control, the applied voltage increased owing to the increase in volume resistance. Due to the raised applied voltage, the electrification potential of the belt increased, transfer non-uniformity occurred due to a charge removal nonuniformity between portions with a toner and without such, and residual images were observed. In case of 10,000 copies, too, the density decrease due to insufficient current occurred in case of the constant voltage control, and residual images appeared for the same reason as described above with reference to the constant current control.

When the laminated belt No. 11 was used, the unit was temporarily stopped after 100 continuous copies and the volume resistivity ρv was measured 10 seconds after the stop. The volume resistivity ρv returned to the original state and assumed a value equal to the initial value. However, when the volume resistivity ρv was measured after 10,000 copies, the volume resistivity ρv increased and the decrease in density of the images also occurred due to insufficient transfer.

The belt No. 9 with an absolute value Δρv of the amount of changes in the volume resistivity of 0.76 was a monolayer belt, but the volume resistivity ρv apparently increased due to poor dispersivity of the electrically conductive agent. In this belt, too, when 100 copies were continuously made, density decrease was confirmed in case of constant voltage control, and residual images were observed in case of constant current control. Similarly, when 10,000 copies were made, the increase in volume resistivity ρv was observed and residual images and density decrease caused by insufficient transfer were confirmed in case of the constant voltage control. On the other hand, under the constant current control, residual images were confirmed.

On the other hand, in case of the belt No. 11 with an absolute value Δρv of the amount of changes in the volume resistivity of −0.68, the volume resistivity ρv decreased apparently due to the formation of identical paths of CB. As a result of such an increase in resistance, in case of the constant voltage control, when 100 copies were continuously made, an electric current in excess of the correct current was flowing, the transfer electric field increased, and the gap discharge caused the appearance of transfer dust or excessive transfer was observed.

Similarly, in case of 10,000 copies, too, the reduction of volume resistivity ρv has occurred and an excessive transfer or residual images caused by the excessive transfer were observed. Furthermore, in case of the constant current control, when 100 copies were continuously made, the electric current was flowing from the toner portions with a high resistance to portions with a low resistance. As a result, the resistance of the belt outside the toner portions was decreased. Such an occurrence of nonuniformity in the belt resistance resulted in transfer nonuniformity and residual images were observed. Similarly, in case of 10,000 copies, too, the residual images were confirmed for similar reasons.

In belts Nos. 6, 9, 10 in which the absolute value Δρv of the amount of changes in the volume resistivity was 0.5 or less, the volume resistivity ρv changed little even after 10,000 copies, and abnormal images did not appear under the constant current control or the low-voltage control.

The above-described facts suggest the following. Images without distortions can be obtained within a long interval if the image forming apparatus uses an intermediate transfer belt in which the absolute value Δρv of the amount of changes in the volume resistivity within 2 seconds to 100 seconds from the beginning of voltage application is 0.5 [Log(Ω·cm)] or less when a voltage of 200 V is continuously applied.

Further, in the present embodiment, the explanation was conducted with respect of an image forming apparatus of an intermittent transfer system shown in FIG. 1. However, the present invention can be also employed in image forming apparatuses of a continuous transfer system shown in FIG. 8. Components in the apparatus shown in FIG. 8 which have the same structure as those in the above-described image forming apparatus of an intermittent transfer system are assigned with the reference symbols identical to those in FIG. 1.

In this image forming apparatus, a total of four tone image forming sections comprising a development unit and a photosensitive unit are provided for forming images of each color, similarly to the above-described image forming apparatus of an intermittent transfer system. Furthermore, a light writing unit, a paper feed cassette, a transfer transportation unit, a fixing unit, and a paper output tray are also provided similarly to the above-described image forming apparatus of an intermittent transfer system.

Figure 9:
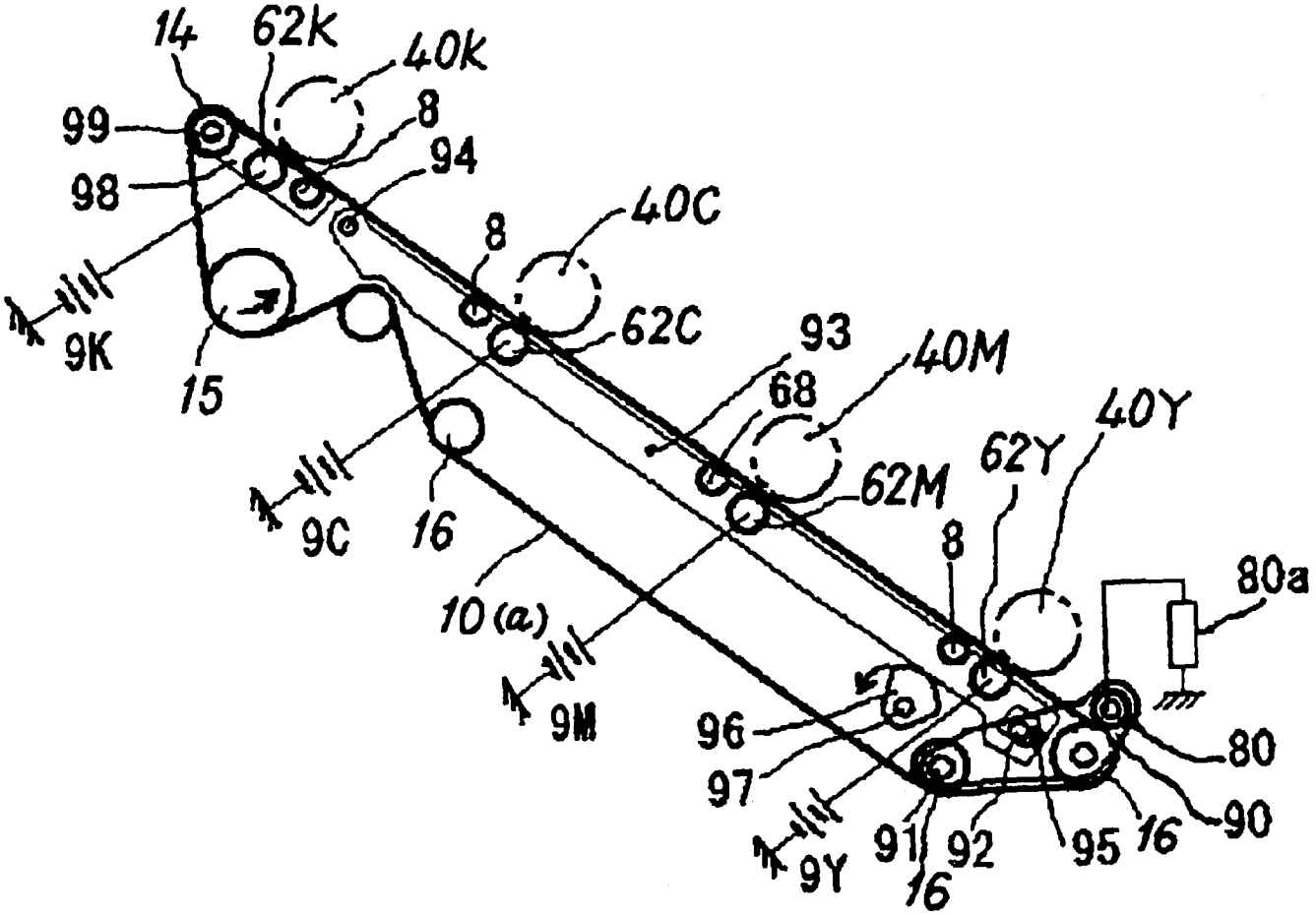
FIG. 9 is an enlarged view of the main portion of the image forming unit of an image forming apparatus of a direct transfer system according to another embodiment of the present invention.

A schematic configuration of the above-mentioned transfer transportation unit is shown in FIG. 9. A transfer transportation belt 10*a* herein is stretched over support rollers 14-16 so as to pass through transfer positions in contact with the drum-like photosensitive bodies 40Y, 40M, 40C, and 40K of each toner image forming unit.

An electrostatic attraction roller 80 for transporting a transfer material to which a prescribed voltage was applied from a power source 80*a* is disposed at the outer surface of the transfer transportation belt 10*a*, so as to face the inlet. roller 16 at the upstream side in the direction of transfer paper movement, among those support rollers. The transfer paper that passed between the two rollers 16, 80 is supported by electrostatic attraction on the transfer transportation belt 10*a*. The roller 15 is a drive roller for friction driving the transfer transportation belt 10*a*; it is connected to a drive source (not shown in the figure) and rotates in the direction shown by an arrow.

Transfer rollers 62Y, 62M, 62C, 62K are provided, so as to be in contact with the rear surface of the transfer transportation belt 10*a*, in the positions facing the photosensitive bodies 40, as means for applying an electric field for forming a transfer field in each transfer position. A transfer bias is applied to those transfer rollers from respective transfer bias sources 9Y, 9M, 9C, 9K. Under the effect of the applied transfer bias, a transfer charge is provided to the transfer transportation belt 10*a*, and a transfer field of a prescribed intensity is formed between the transfer transportation belt

10*a* and the surface of the photosensitive bodies 40 in each transfer position. Further, a backup roller 68 is provided in order to maintain adequate contact between the transfer paper and photosensitive body in the region where the aforementioned transfer is conducted and to obtain optimum transfer nip.

Figure 8:
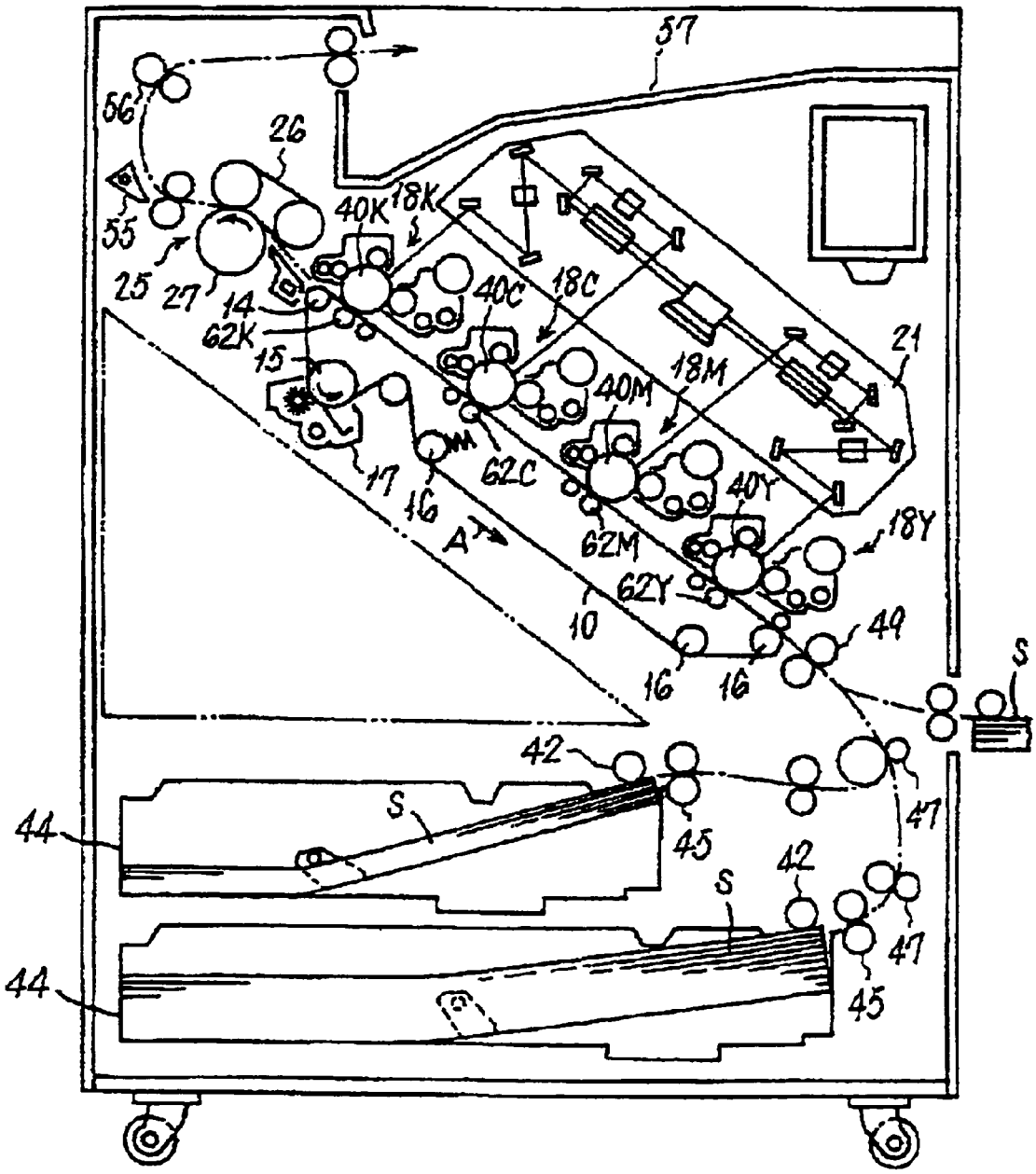
FIG. 8 illustrates a schematic configuration of an image forming apparatus of a direct transfer system according to another embodiment of the present invention.

A dash-dot line in FIG. 8 described hereinabove shows a transportation path of transfer paper. Transfer paper fed from a paper feed cassette 44 of a manual feed tray S is transported by the transportation rollers, while being guided with a transportation guide (not shown in the figure), and sent to a temporary stop portion where a resist roller pair 49 is provided. The transfer paper that was set at the prescribed timing by the resist roller pair 49 is supported by the transfer transportation belt 10*a*, transported toward the toner image formation units 18Y, 18M, 18C, 18K, and passed by the transfer nips formed in each transfer position.

In a color mode in which full-color images are formed, the toner images developed on the photosensitive bodies 40Y, 40M, 40C, 40K of the toner image formation units 18Y, 18M, 18C, 18K are superimposed on the transfer paper with respective transfer nips. Those toner images are then transferred onto the transfer paper under the effect of transfer electric field and nip pressure. A full color toner image is formed on the transfer paper by such a superposition transfer.

The transfer transportation belt 10*a* used in the transfer transportation unit is a monolayer belt formed of a polyimide resin comprising at least carbon black as an electrically conductive agent. Further, the surface resistivity is 9-12 [Log(Ω/⊠)], more preferably 10-11.5 [Log(Ω/⊠)]. The volume resistivity is set within a range of 7-10 [Log(Ω·cm)], more preferably 8-9.5 [Log(Ω·cm)]. When the surface resistivity ρs is measured by applying a voltage of 500 V, the absolute value Δρs of the logarithmic difference in the measured values representing a 2-sec value and 100-sec value after the beginning of voltage application is 0.3 [Log(Ω/⊠)] or less. When the volume resistivity ρv is measured by applying a voltage of 200 V, the absolute value Δρv of the logarithmic difference in the measured values representing a 2-sec value and 100-sec value after the beginning of voltage application is 0.5 [Log(Ω·cm)] or less.

The image forming apparatus of the present embodiment employed the transfer transportation belt that was evaluated based on the fluctuation characteristic of the resistivity in the continuous voltage application interval, but the above-described evaluation method may be also applied to a development roller or photosensitive bodies which are also the electric charge carrying members.

Further, in the present embodiment, the application of the present invention to a transfer belt of an image forming apparatus was described, but the present invention is not limited thereto. For example, the application to the transfer belt and photosensitive belt which are also the electric charge carrying members is also possible by changing the evaluation criteria for the absolute values of the difference in volume resistivity or surface resistivity after 2 seconds and 100 seconds from the beginning of voltage application. Further, a general application to other electric resistance members is also possible.

In the present embodiment, the members that were evaluated based on the absolute value of the difference in the resistivity after 2 seconds and 100 seconds from the beginning of voltage application in a continuous voltage application mode were used as the transportation belt and intermediate transfer belt as transfer belts. As a result, changes in the resistivity of the transfer belts are eliminated. Therefore, transfer defects do not occur and good image can be maintained even in long-term utilization.

Furthermore, in the present embodiment, the transfer belts satisfied the criterion of the absolute value of the variation in the surface resistivity after 2 seconds and 100 seconds from the beginning of voltage application being 0.3 [Log(Ω/⊠)] or less in a continuous 500 V voltage application mode. As a result, transfer belts with small fluctuations of surface resistivity with time can be obtained, and good images can be provided over a long period.

Furthermore, in the present embodiment, the transfer belts satisfied the criterion of the absolute value of the variation in the volume resistivity after 2 seconds and 100 seconds from the beginning of voltage application being 0.5 [Log (Ω·cm)] or less in a continuous 200 V voltage application mode. As a result, the intermediate transfer belt and transportation belt with small fluctuations of surface resistivity with time can be obtained, and good images can be provided over a long period.

Further, the transfer belts of the present embodiment have a monolayer structure comprising at least carbon black as an electrically conductive agent. Employing carbon black having good dispersivity makes it possible to obtain belts with uniform resistance. Furthermore, because the transfer belts have a monolayer structure, the accumulation of electric charge is prevented and the increase in the electric resistance with time can be suppressed.

Further, in the present embodiment, the electric field generation means was constant current controlled. In the present embodiment, because the intermediate transfer belt and transportation belt with small fluctuations of surface resistivity with time are used, the leak of electric current in the circumferential direction of the belt surface is small. As a result, the transfer electric field can be maintained over a long period even in the constant current control mode. Therefore, the occurrence of image defects such as insufficient transfer is prevented despite certain fluctuations of resistivity with time.

Further, in the present embodiment, the transfer bias application member serving as transfer electric field formation means is provided in the position opposite the photosensitive body, in contact with the transfer belt. Therefore, the transfer bias can be directly applied to the transfer nip portion. As a result, the voltage in the transfer nip portion can be lowered with respect to that in the system in which the transfer electric field is applied indirectly. Therefore, a margin exists for the limit of the capacity of the transfer voltage source, and no adverse effect is produced on image quality even when the transfer belt has a high resistance.

As described hereinabove, the present invention makes it possible to evaluate the fluctuations of the resistance of the electric resistance member with time by examining changes in the resistivity caused by continuous voltage application. Therefore, the evaluation method in accordance with the present invention can be applied to charge carrying members of image forming apparatuses in which changes in the resistivity with time produce a large effect on the image. Furthermore, among the charge carrying members of image forming apparatuses, the evaluation method in accordance with the present invention may be especially effectively applied to a transfer belt.

Further, with the present invention, assembling the transfer member selected by the aforementioned method in an image forming apparatus makes it possible to obtain an image forming apparatus capable of maintaining good. image, without transfer defects, even in a long-time use.

Various modifications will become possible for those skilled in the art after receiving the teachings of the present disclosure without departing from the scope thereof.

What is claimed is:

1. An image forming apparatus comprising:

an image carrying body, and transfer means for transferring a developing agent present on the image carrying body onto a transfer surface of a transfer member with electric field application means, wherein at least said transfer member comprises an electric charge carrying member evaluated by a resistance change evaluation method, and said resistance change evaluation method comprises disposing an inner electrode and a ring electrode above the electric resistance member, applying a voltage continuously to the electric resistance member, and evaluating changes in the resistivity within 2 seconds to 100 seconds from the beginning of voltage application with time based on a fluctuation characteristic of the resistivity in a continuous voltage application interval.

2. The image forming apparatus as claimed in claim 1, wherein said electric field application means is constant current controlled.

3. The image forming apparatus as claimed in claim 1, wherein said electric field application means is provided in a region where said image carrying body and transfer member are in contact with each other.

4. The image forming apparatus as claimed in claim 1, wherein said image carrying body is provided in a plurality and the developing agent present on each image carrying body is superimposed on the transfer surface of the transfer member with the transfer means.

5. The image forming apparatus as claimed in claim 4, wherein said transfer means is an intermediate transfer belt and a transfer image that was transferred onto said intermediate transfer belt is transferred onto a transfer material.

6. A method for evaluating changes in the resistance of an electric resistance member, comprising:

applying a voltage continuously to the electric resistance member, and evaluating changes in the resistivity with time based on the amount of changes in the resistivity within 2 seconds to 100 seconds from the beginning of voltage application, wherein said electric resistance member is an electric charge carrying member used in an image forming apparatus and said electric charge carrying member is a transfer member in contact with a image carrying body, wherein the evaluating changes measures the surface resistivity of the electric resistance member by placing the electric resistance member on an insulating plate.

7. The method for evaluating changes in the resistance, as claimed in claim 6, wherein said electric resistance member is an electric charge carrying member used in an image forming apparatus.

8. The method for evaluating changes in the resistance, as claimed in claim 7, wherein the evaluation criterion for the changes in the surface resistivity of said transfer member with time is whether or not the absolute value of the amount of changes in the surface resistivity within 2 seconds to 100 seconds from the beginning of voltage application in continuous application of a voltage of 500 V is 0.3 or less.

9. The method for evaluating changes in the resistance, as claimed in claim 7, wherein the evaluation criterion for the changes in the volume resistivity of said transfer member with time is whether or not the absolute value of the amount of changes in the volume resistivity within 2 seconds to 100 seconds from the beginning of voltage application in continuous application of a voltage of 200 V is 0.5 or less.

10. The method for evaluating changes in the resistance, as claimed in claim 7, wherein said transfer member is a monolayer structure comprising at least carbon as an electrically conductive agent, the surface resistivity thereof is 9 or more and 12 or less, and the volume resistivity thereof is 7 or more and 10 or less.

11. The method for evaluating changes in the resistance, as claimed in claim 7, wherein said transfer member comprises an endless belt.

* * * * *